US007420139B2

(12) United States Patent
Yoshikawa et al.

(10) Patent No.: US 7,420,139 B2
(45) Date of Patent: Sep. 2, 2008

(54) GLOW PLUG

(75) Inventors: Takaya Yoshikawa, Kasugai (JP); Shinya Murakoshi, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 304 days.

(21) Appl. No.: 10/556,053

(22) PCT Filed: Feb. 18, 2005

(86) PCT No.: PCT/JP2005/002569

§ 371 (c)(1),
(2), (4) Date: Nov. 8, 2005

(87) PCT Pub. No.: WO2005/080877

PCT Pub. Date: Sep. 1, 2005

(65) Prior Publication Data

US 2007/0056949 A1 Mar. 15, 2007

(30) Foreign Application Priority Data

Feb. 19, 2004 (JP) ..... 2004-043378

(51) Int. Cl.
*F23Q 7/22* (2006.01)
*H01T 13/20* (2006.01)

(52) U.S. Cl. ..... 219/270; 313/141

(58) Field of Classification Search ..... 219/270, 219/260, 261, 262, 263, 264, 266, 265, 267, 219/268, 269; 313/141, 135, 118
See application file for complete search history.

(56) References Cited

U.S. PATENT DOCUMENTS 6,603,244 B2 * 8/2003 Sugiyama et al. ..... 313/118
6,744,188 B2 * 6/2004 Nishikawa et al. ..... 313/141
6,881,930 B2 * 4/2005 Yoshikawa et al. ..... 219/270
6,979,801 B2 * 12/2005 Okazaki et al. ..... 219/270
7,223,942 B2 * 5/2007 Konishi et al. ..... 219/270
7,224,256 B2 * 5/2007 Parsons ..... 338/25
2002/0067110 A1 * 6/2002 Nishikawa et al. ..... 313/118
2002/0158559 A1 * 10/2002 Sugiyama et al. ..... 313/141
2004/0066124 A1 * 4/2004 Kanao et al. ..... 313/135

FOREIGN PATENT DOCUMENTS

JP 9-42671 A 2/1997
JP 2002-13734 A 1/2002
JP 2002-174423 A 6/2002
JP 2002-364841 A 12/2002

* cited by examiner

*Primary Examiner*—Daniel L Robinson
(74) *Attorney, Agent, or Firm*—Sughrue Mion, PLLC

(57) ABSTRACT

An object is to provide a glow plug in which a gap can be prevented from being generated between a ceramic heater and a cylindrical member even at the time of use in an internal combustion engine, etc. so that electrical conduction of the glow plug can be prevented from being lowered. A glow plug includes: a rod-shaped ceramic heater 2; a rod-shaped center pole 5 extending axially so as to electrically connect to the outside; and a cylindrical member 100 having a front end portion 101 bonded to an outer circumferential surface 2*a* of a rear end side of the ceramic heater 2, and a rear end portion 102 bonded to an outer circumferential surface of a front end side of the center pole 5, the cylindrical member 100 being made by a metal material for electrically connecting one of a pair of lead portions and the center pole 5 to each other, the glow plug characterized in that the cylindrical member 100 has a Vickers hardness of not lower than 200 HV at 25° C.

11 Claims, 6 Drawing Sheets

(a)

(b)

GLOW PLUG

TECHNICAL FIELD

The present invention relates to a ceramic glow plug for preheating the inside of a cylinder of a Diesel engine or a glow plug used in a heating plug for preheating water.

BACKGROUND ART

As shown in FIG. 7, a glow plug 90 according to the background art has a rod-shaped ceramic heater 91, a cylindrical outer pipe 92, and a cylindrical metal shell 93. The ceramic heater 91 is held in the outer pipe 92 by tight fitting in the condition that a front end portion 91*a* and a rear end portion 91*b* of the ceramic heater 91 are protruded from the outer pipe 92. A front end portion of the metal shell 93 is bonded to an outer circumferential surface 92*a* of a rear end portion of the outer pipe 92. The ceramic heater 91 has a heating portion 912 in a front end portion 911*a* of a ceramic heater body 911. The heating portion 912 generates heat when electricity is applied to the ceramic heater 91. The ceramic heater body 911 extends in a direction of an axis O. The ceramic heater 91 further has a pair of lead portions 913 for current conduction. The pair of lead portions 913 are provided to extend from the heating portion 912 so that the pair of lead portions 913 are exposed to an outer circumferential surface of a rear end side 911*b* of the ceramic heater body 911. Application of electricity to the ceramic heater 91 is performed by a rod-shaped center pole 94 and a cylindrical member 95 in the following manner (e.g. see Patent Document 1). That is, the center pole 94 is located in the rear of the ceramic heater 91 in the direction of the axis O and extends in the direction of the axis so as to be electrically connected to the outside. The cylindrical member 95 has a front end portion 951 bonded to the outer circumferential surface of the rear end side 911*b* of the ceramic heater 91 by a wax material, and a rear end portion 952 bonded to an outer circumferential surface of a front end portion 94*a* of the center pole 94 by caulking so that one of the lead portions 913 is electrically connected to the center pole 94. As the material of the cylindrical member 95, a metal elastic material having elasticity such as stainless steel, copper, etc. is used in consideration of caulking, etc.

Patent Document 1: Japanese Patent Laid-Open No. 42671/1997 (FIG. 3)

DISCLOSURE OF THE INVENTION

Problem That the Invention is to Solve

When the cylindrical member 95 made by the metal elastic material as disclosed in Patent Document 1 is boned to the ceramic heater 91 by the wax material, there is however a possibility that sufficient force to tighten the ceramic heater 91 cannot be obtained. When the glow plug 90 is attached to an internal combustion engine for use, heat load is applied on the ceramic heater 91 and the cylindrical member 95 to thereby bring thermal expansion of both the ceramic heater 91 and the cylindrical member 95. On this occasion, there is a tendency that the cylindrical member 95 thermally expands more intensively than the ceramic heater 91. Thus, the force of the cylindrical member 95 to tighten the ceramic heater 91 cannot be obtained sufficiently. When such a glow plug 90as described above is used, a gap may be generated between the ceramic heater 91 and the cylindrical member 95. Although the wax material is interposed between the ceramic heater 91 and the cylindrical member 95, such a gap is formed between the wax material and the ceramic heater 91 if wettability between the wax material and the ceramic is not sufficient. In this case, oxygen enters the gap to oxidize the exposed surface of the exposed lead portion 913, so that there is a possibility that contact resistance between the lead portion 913 and the cylindrical member 95 is increased, and that electric conduction of the glow plug 90 is lowered accordingly.

The present invention is achieved in order to solve the aforementioned problem. An object of the present invention is to provide a glow plug in which a gap can be prevented from being generated between a ceramic heater and a cylindrical member even at the time of use in an internal combustion engine, etc., so that electric conduction of the glow plug can be prevented from being lowered.

Means for Solving Problem

In order to achieve the foregoing object, the present invention (invention as described in claim 1) provides a glow plug including: a rod-shaped ceramic heater including a ceramic heater body extending axially, a heating portion embedded in a front end portion of the ceramic heater body and being capable of generating heat upon energization, and a pair of lead portions each having one end connected to the heating portion, and the other end exposed to an outer circumferential surface of a rear end portion of the ceramic heater body; a rod-shaped center pole extending axially so as to be electrically connected to the outside; and a cylindrical member having a front end portion bonded to an outer circumferential surface of a rear end side of the ceramic heater, and a rear end portion bonded to an outer circumferential surface of a front end side of the center pole, the cylindrical member being made by a metal material for electrically connecting one of the pair of lead portions and the center pole to each other, the glow plug characterized in that the cylindrical member has a Vickers hardness of not lower than 200 HV at 25° C.

In the glow plug according to the present invention, the Vickers hardness of the cylindrical member at 25° C. is not lower than 200 HV. Since the cylindrical member is made harder than the conventional one, sufficient force to tighten the ceramic heater can be obtained when the cylindrical member is bonded to the ceramic heater. Accordingly, a gap can be prevented from being generated between the ceramic heater and the cylindrical member even at the time of use in an internal combustion engine, etc., so that electrical conduction of the glow plug can be prevented from being lowered. Incidentally, the aforementioned effect cannot be obtained sufficiently if the Vickers hardness is lower than 200 HV. On the other hand, it is preferable that the Vickers hardness of the cylindrical member at 25° C. is not higher than 500 HV. If the Vickers hardness exceeds 500 HV, workability deteriorates and there is a possibility that the ceramic heater may be broken at the time of bonding the cylindrical member to the ceramic heater. Incidentally, the cylindrical member and the ceramic heater may be bonded to each other by a wax material or by tight fitting.

As described in claim 2, in the aforementioned glow plug, preferably, the front end portion of the cylindrical member is bonded to the outer circumferential surface of the rear end side of the ceramic heater by tight fitting. When the cylindrical member and the ceramic heater are bonded to each other by tight fitting, tightening force can be obtained sufficiently, compared with bonding based on a wax material. This is effective in manufacturing and cost. Incidentally, when a cylindrical member as low in hardness as that in the background art is used in the case of tight fitting, the cylindrical member is deformed excessively with respect to the ceramic heater at the time of bonding the cylindrical member to the ceramic heater, so that there is a possibility that force to tighten the ceramic heater cannot be obtained sufficiently. When the cylindrical member is bonded to the ceramic heater by use of the present invention, sufficient force to tighten the ceramic heater can be obtained. Accordingly, a gap can be prevented from being generated between the ceramic heater and the cylindrical member even at the time of use in an internal combustion engine, etc., so that electrical conduction of the glow plug can be prevented from being lowered. Incidentally, as the tight fitting, press fitting, shrink fitting, expansion fitting, etc. may be conceived. Among them, press fitting is preferred. Press fitting permits tight fitting to be performed easily in manufacturing. In addition,press fitting permits the cylindrical member to be kept at a sufficiently high hardness because the cylindrical member does not suffer cold in manufacturing.

Incidentally, it is preferable that 15% or more of the cylindrical member is tight-fitted as the front end portion of the ceramic heater when viewed in the axial direction of the ceramic heater. If it is less than 15%, the margin of tight fitting to the ceramic heater is reduced so that the cylindrical member may crack. On the other hand, it is also preferable that the rate of the tight-fitted cylindrical member is not higher than 90%. When it exceeds 90%, the rear end portion of the cylindrical member is reduced to thereby reduce the place for bonding the cylindrical member to the center pole, so that it may be impossible to obtain the stress relaxation effect effectively.

When the cylindrical member as described in the present invention is made harder than that in the background art, the following problem may arise. In recent years, with the advance of direct injection of the Diesel engine, the front end portion of the ceramic heater has been directly disposed in the inside of the combustion chamber. On this occasion, the front end portion of the ceramic heater is repetitively pressed toward the rear end side in the axial direction due to the combustion pressure, etc. of the Diesel engine. As a result, the ceramic heater is apt to vibrate in the axial direction. When a high-hardness cylindrical member as described in the present invention is used in the glow plug (see FIG. 7) as described in Patent Document 1 in which the center pole and the metal shell are fixed to each other by the glass seal 96, there is a possibility that pressure applied on the ceramic heater rearwards in the axial direction is not relaxed by the cylindrical member but applied on the center pole so that there is a possibility that the glass seal 96 may be broken. Accordingly, short-circuiting between the center pole and the metal shell or dropping of the center pole out of the metal shell may occur.

As describe in claim 4, preferably, the aforementioned glow plug further includes: an outer pipe for holding the ceramic heater while front and rear end portions of the ceramic heater are protruded from the outer pipe; a metal shell for surrounding a frond end side of the center pole while holding the outer pipe; and an elastic member disposed so as to be located in a gap between the center pole and the metal shell.

That is, in the glow plug according to the present invention, insulation between the center pole and the metal shell can be attained by the elastic member. In addition, the elastic member allows the center pole to move toward the rear end side in the axial direction, so that the elastic member is not broken like the glass seal in the background art because the elastic member can even absorb the movement of the ceramic heater toward the rear end side in the axial direction due to long-term vibration from the ceramic heater or excessive combustion pressure. Accordingly, even in the state that the ceramic heater is pressed due to the combustion pressure, etc., the center pole bonded to the ceramic heater through the cylindrical member can be prevented from dropping out while insulation between the center pole and the metal shell is attained. Incidentally, a packing or an O-ring may be used as the elastic member.

As described in claim 5, in the aforementioned glow plug, preferably, the elastic member is engaged with a rearward surface of the metal shell; and the glow plug further includes a cylindrical insulating member disposed on a rear end side of the elastic member so as to press the elastic member. Since the insulating member presses the elastic member, an air-fuel mixture in the inside of the combustion chamber is not released to the outside through the gap inside the glow plug. Incidentally, the insulating member is preferably disposed with a space with respect to the gap between the metal shell and the center pole. Accordingly, the insulating member is not broken even when movement of the ceramic heater toward the rear end side in the axial direction due to long-term vibration from the ceramic heater or excessive combustion pressure occurs. In addition, in a section of the insulating member perpendicular to the axial direction, the insulating member preferably has a region accounting for 60% or more of the center pole. Since the region accounts for 60% or more, the insulating member can press the elastic member sufficiently.

The rearward surface of the metal shell is provided as a part of an inner wall of a through-hole of the metal shell. The rearward surface of the metal shell may be a surface formed so as to be perpendicular to the axial direction or a taper surface in which the through-hole has an inner diameter increasing toward the rear end side in the axial direction.

As described in claim 6, in the aforementioned glow plug, preferably, the rear end portion of the cylindrical member is bonded to an outer circumferential surface of a rear end side of the center pole by welding. Accordingly, the high-hardness cylindrical member and the center pole can be bonded to each other firmly. Incidentally, welding between the cylindrical member and the center pole may be any one of resistance welding, ultrasonic welding and laser welding as long as the cylindrical member and the center pole can be electrically connected to each other.

As described in claim 7, the glow plug according to the present invention is characterized in that there is used a metal member having a cylindrical front end portion bonded to an outer circumferential surface of a rear end side of the ceramic heater by tight fitting, brazing, etc., and a rear end portion bonded to an outer circumferential surface of a front end side of the center pole, the metal member being provided for electrically connecting one of the pair of lead portions and the center pole to each other, the metal member having a Vickers hardness of not lower than 200 HV at 25° C. Since the metal member harder than that in the background art is used in the glow plug, force of the cylindrical front end portion to tighten the ceramic heater can be increased when the cylindrical member is bonded to the ceramic heater. Accordingly, a gap can be prevented from being generated between the ceramic heater and the cylindrical front end portion of the metal member even at the time of use in an internal combustion engine, etc., so that electrical conduction of the glow plug can be prevented from being lowered. Incidentally, the aforementioned effect cannot be obtained sufficiently if the Vickers hardness is lower than 200 HV. On the other hand, it is preferable that the Vickers hardness of the metal member at 25° C. is not higher than 500 HV. When the Vickers hardness exceeds 500 HV, workability of the metal member deteriorates and there is a possibility that the ceramic heater may be broken at the time of bonding the metal member to the ceramic heater.

DESCRIPTION OF REFERENCE NUMERALS

1, 90, 400, 500 . . . glow plug, 2 . . . ceramic heater, 21 . . . ceramic heater body, 22 . . . heating portion, 23, 24 . . . lead portion, 3, 403, 503. . . outer pipe, 31 . . . protrusion portion, 4 . . . metal shell, 5 . . . center pole, 46 . . . ceramic ring, 7 . . . glass filler layer, 8 . . . insulating bush, 9 . . . terminal fitment, 100 . . . cylindrical member, 200 . . . composite molded product, 211, 212 . . . split molded piece, 220 . . . heating portion powder molded piece

BEST MODE FOR CARRYING OUT THE INVENTION

An embodiment of the present invention will be described below with reference to the drawings.

Figure 1:
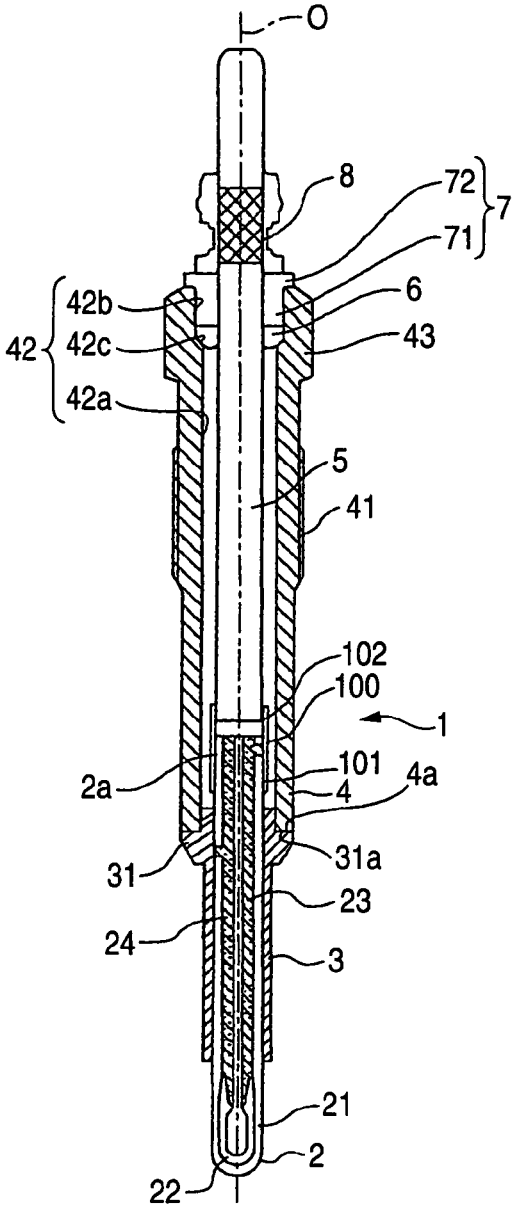
[FIG. 1] A longitudinal section of a glow plug 1 showing Embodiment 1 of the present invention.
Figure 2:
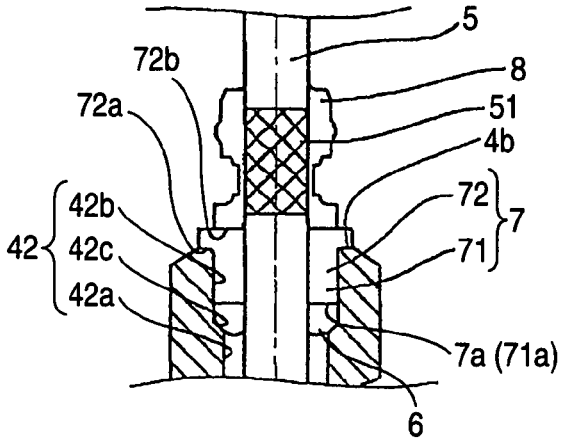
[FIG. 2] A longitudinal section showing important part of FIG. 1.

FIG. 1 shows an internal structure of a glow plug 1 as an example of the present invention. FIG. 2 is an enlarged view of important part of the glow plug 1. The glow plug 1 mainly has a ceramic heater 2, an outer pipe 3 for holding the ceramic heater 2, a metal shell 4 for holding the outer pipe 3, and a center pole 5 disposed in the rear of the ceramic heater 2.

The ceramic heater 2 includes a rod-shaped ceramic heater body 21, a heating portion 22 embedded in a front end portion of the ceramic heater 21, and a pair of lead portions 23 and 24 electrically connected to the heating portion 22 and exposed from an outer circumferential surface of a rear end portion of the ceramic heater 21. The ceramic heater body 21 is made by insulating ceramics containing silicon nitride ($Si_3N_4$) as a main component. The heating portion 22 is made by a mixture of conducting ceramics such as tungsten carbide (WC), molybdenum disilicide ($MoSi_2$), tungsten disilicide ($WSi_2$), etc and insulating ceramics. The heating portion 22 is formed into a U shape. Each of the lead portions 23 and 24 is made by a conducting ceramics-insulating ceramics mixture different in electrical resistivity from the heating portion 22.

The outer pipe 3 is a cylindrical member of stainless steel such as SUS630, SUS430, etc. having a protrusion portion 31 protruding radially and provided on a rear end side. The ceramic heater 2 is held in the outer pipe 3 in the condition that front and rear end portions of the ceramic heater 2 are protruded from the outer pipe 3. The metal shell 4 and the outer pipe 3 are fitted to each other so that a front end surface 4*a* of the metal shell 4 made by S40C abuts on a rear end surface 31*a* of the protrusion portion 31 of the outer pipe 3. Then, the metal shell 4 and the outer pipe 3 are welded to each other by laser. The outer pipe 3 electrically connects one lead portion 24 and the metal shell 4 to each other.

The metal shell 4 has a thread portion 41 and a tool engagement portion 43 in its outer circumferential surface. The thread portion 41 is provided for fixing the glow plug 1 to an engine block. The tool engagement portion 43 is provided for attaching a spanner, a wrench or the like thereto. To fix the glow plug 1 to the engine block, the protrusion portion 31 of the outer pipe 3 abuts on a fixation portion of the engine block. A through-hole 42 extending in an axial direction of the metal shell 4 is formed from a small diameter hole 42*a* located on a front end side, a large diameter hole 42*b* located on a rear end side and having a diameter larger than that of the small diameter portion 42*a*, and a step portion 42*c* for connecting the small diameter hole 42*a* and the large diameter hole 42*b* to each other.

Next, the outer circumferential surface 2*a* of the rear end portion of the ceramic heater 2 is press-fitted into a front end portion 101 of a cylindrical member 100 of stainless steel such as SUS630, SUS430, etc. so as to be electrically connected to the lead portion 23 (the other lead portion than the lead portion connected to the outer pipe). On the other hand, a rear end portion 102 of the cylindrical member 100 is bonded to an outer circumferential surface of a front end portion of the center pole 5 by means of resistance welding, laser welding, or the like. Incidentally, the center pole 5 and the ceramic heater 1 are disposed so that a gap of 0.4 mm is formed therebetween in the axial direction.

The cylindrical member 100 has a Vickers hardness of 420 HV at 25° C. Since the cylindrical member 100 has a Vickers hardness of not lower than 200 HV as described above, sufficient force to tighten the ceramic heater 2 can be obtained when the cylindrical member 100 is bonded to the ceramic heater 2. Accordingly, a gap can be prevented from being generated between the ceramic heater 2 and the cylindrical member 100 even at the time of use in an internal combustion engine, etc., so that electrical conduction of the glow plug 1 can be prevented from being lowered. Incidentally, a work-hardened material of SUS430, an age-hardened material of SUS630, etc. may be used as the cylindrical member 100.

The center pole 5 is disposed so that a gap is formed between the center pole 5 and the metal shell 4 (in an electrically insulating state). An O-ring 6 made by rubber is fitted into the gap so as to abut on the step portion 42*c* of the metal shell 4. An insulating bush 7 is fitted into the rear end side of the O-ring 6. Specifically, the insulating bush 7 is formed from a small diameter portion 71 and a large diameter portion 72 larger in diameter than the small diameter portion 71. The small diameter portion 71 is inserted into the large diameter hole 42*b* of the metal shell 4 so that a front end surface 7*a* (front end surface 71*a* of the small diameter portion) of the insulating bush is pressed against the O-ring 6. On the other hand, the large diameter portion 72 is located on the rear end side of the metal shell 4 so that a front end surface 72*a* of the large diameter portion 72 abuts on the rear end surface 4*b* of the metal shell 4. Moreover, a front end surface 8*a* of a pressure ring 8 for preventing dropping out of the insulating bush 7 abuts on a rear end surface 7*b* (rear end surface 72*b* of the large diameter portion 7) of the insulating bush 7. The pressure ring 8 is fixed to a knurl portion 51 provided in a rear end portion of the center pole 5 by caulking.

Since the O-ring 6 is disposed to abut on the step portion 42*c* of the metal shell 4 in the gap between the center pole 5 and the metal shell 4 as described above, insulation between the center pole 5 and the metal shell 4 can be obtained. At the same time, the O-ring 6 can be prevented from be broken like the conventional glass seal even when movement of the ceramic heater 2 toward the rear end side in the axial direction occurs due to long-term vibration from the ceramic heater 2 or excessive combustion pressure. Accordingly, dropping out of the center pole 5 can be prevented.

Moreover, since the insulating bush 7 pressing the O-ring 6 from the rear end side is provided, an air-fuel mixture inside a combustion chamber is never released to the outside through the gap inside the glow plug.

Incidentally, in this embodiment, the O-ring 6 is equivalent to an elastic member according to the Claims, and the insulating bush 7 is equivalent to an insulating member according to the Claims. The rear end surface 4*b* of the metal shell 4 is equivalent to a rearward surface of a metal shell according to the Claims.

Figure 3:
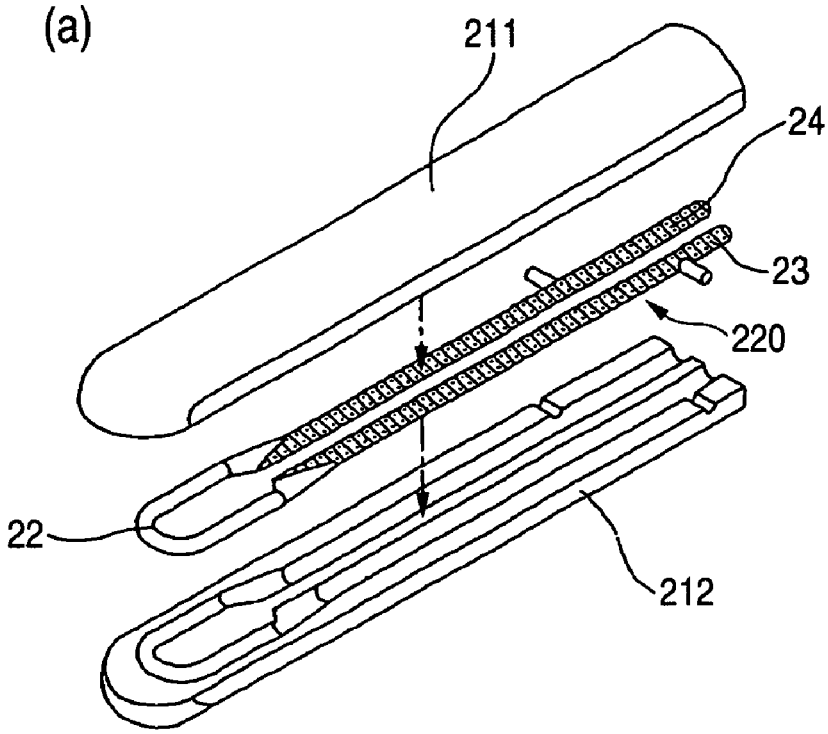
[FIG. 3] An explanatory view of a manufacturing process of a ceramic heater 2 of the glow plug 1.
Figure 3:
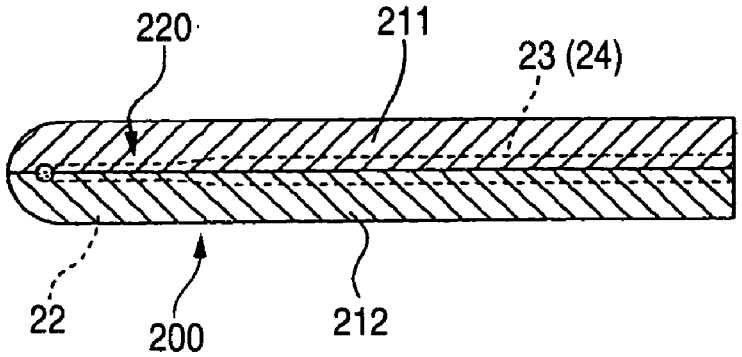

A method for manufacturing a glow plug 1 will be described below. First, as shown in FIG. 3, a heating portion powder molded piece 220 which is formed so that a heating portion 22 and lead portions 23 and 24 are integrated is produced by injection molding. Raw material powder for forming a ceramic heater 21 is molded by mold pressing preliminarily to prepare split molded pieces 211 and 212 as a body molded product having upper and lower molded pieces formed separately. A concave portion having a shape corresponding to the heating portion powder molded piece 220 is formed in each of mating surfaces of the split molded pieces 211 and 212. While the heating portion powder molded piece 220 is received in the concave portions, the split molded pieces are fitted to each other in the mating surfaces and further pressed and compressed. Thus, a composite molded product 200 formed so that these are integrated is produced as shown in FIG. 3(*b*).

Figure 4:
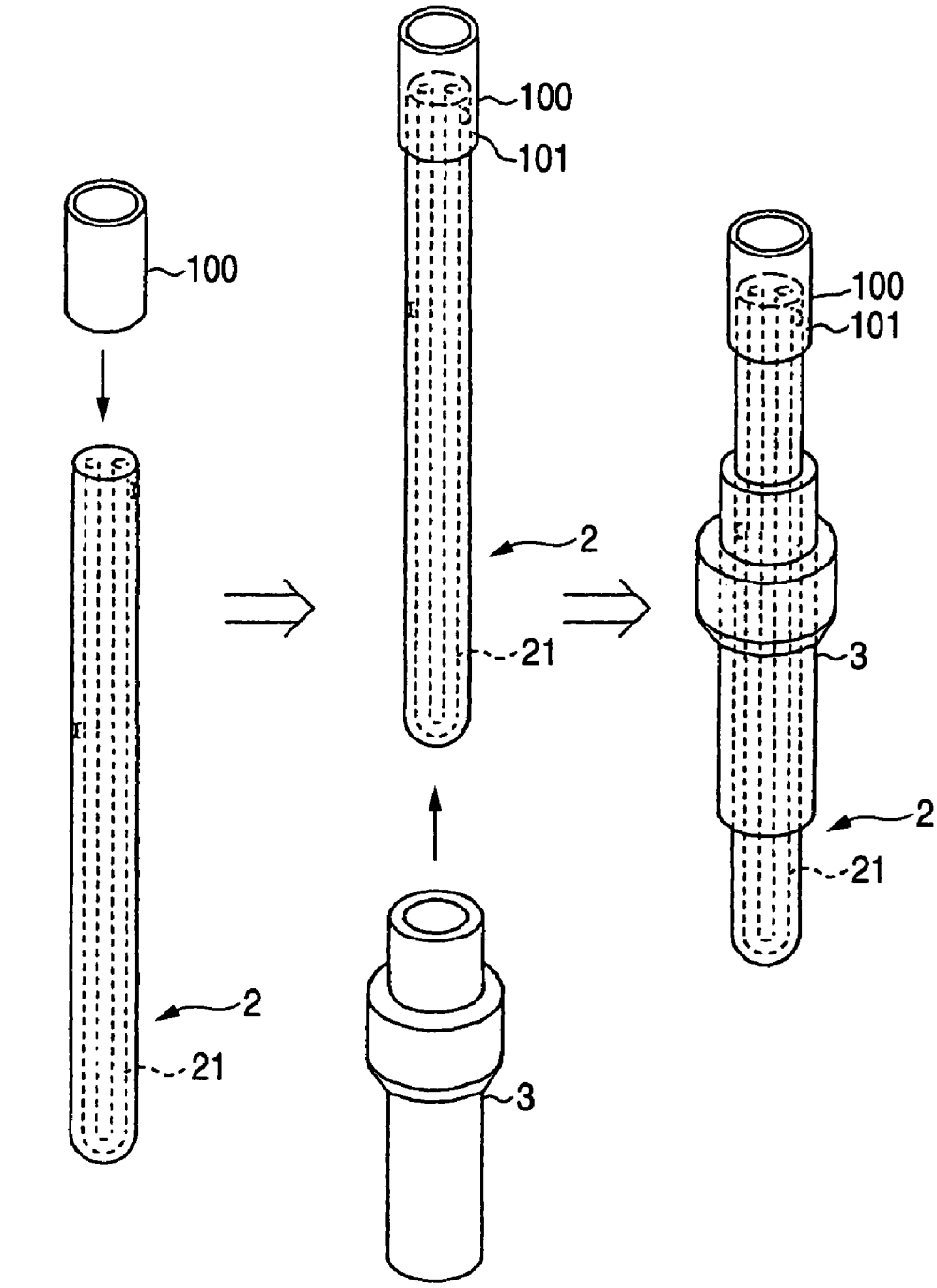
[FIG. 4] An explanatory view of the manufacturing process of the glow plug 1 following FIG. 3.

After the composite molded product 200 obtained thus is subjected to a binder removing process, the composite molded product 200 is sintered at 1700° C. or higher, for example, at about 1800° C. by hot press or the like to thereby form a sintered piece. When the outer circumferential surface of the sintered piece is ground into a cylindrical shape, a ceramic heater 2 is formed. As shown in FIG. 4, the cylindrical member 100 is fitted to the ceramic heater 2 by means of tight fitting such as press fitting so that a front end portion 101 of the cylindrical member 100 is electrically connected to one 23 of a pair of lead portions. Similarly, an outer pipe 3 is fitted to the ceramic heater 2 by means of tight fitting such as press fitting so that the outer pipe 3 is electrically connected to the other 24 of the pair of lead portions.

A front end portion of the center pole 5 is welded to a rear end portion 102 of the cylindrical member 100 by laser welding. Specifically, the rear end side 102 of the cylindrical member 100 is inserted onto the front end portion of the center pole 5 and the overlapping portion is laser-welded on the whole radial circumference. A metal shell 4 is inserted from the rear end side of the center pole 5 and bonded by laser welding in the condition that a front end surface 4*a* of the metal shell 4 and a rear end surface 31*a* of a protrusion portion 31 of the outer pipe 3 abut on each other.

Then, an O-ring 6, an insulating bush 7 and a pressure ring 8 are inserted in order from the rear end side of the center pole 5. Then, while the pressure ring 8 is pressed toward the front end side, the pressure ring 8 is caulked toward the center pole 5. Thus, a glow plug 1 shown in FIG. 1 is completed. Incidentally, since the pressure ring 8 is pressed toward the front end side, the O-ring 6 is pressed against a step hole 42*c* of the metal shell 4.

EXAMPLES

Example 1

Next, in order to confirm the effect of the invention, the following evaluation was made.

First, the relation between the hardness of each cylindrical member 100 and electrical conductivity was examined. A heating portion 22 and lead portions 23 and 24 each made from conducting ceramics such as WC and insulating ceramics were embedded in a ceramic heater body 21 containing $Si_3N_4$ as a main component to thereby produce each rod-shaped ceramic heater 2. Incidentally, the ceramic heater 2 had a diameter of 3.3 mm and a length of 42 mm. The heating portion 22 was embedded in a position 1-6 mm distant from a front end of the ceramic heater 2. Then, front end portions 101 of cylindrical members 100 having different Vickers hardnesses were press-fitted onto the ceramic heaters 2 respectively. Each cylindrical member 100 had a length of 6.5 mm, a diameter of 4.0 mm and an inner diameter of 3.2 mm. The cylindrical members 100 having Vickers hardnesses of 100 HV, 150 HV, 200 HV, 250 HV, 300 HV, 350 HV and 400 HV at 25° C. respectively were prepared. Specifically, an annealed material of SUS430 was used for the cylindrical member 100 having a Vickers hardness of 100 HV, a work-hardened material of SUS430 was used for the cylindrical member 100 having a Vickers hardness of 150 HV, a work-hardened material of SUS430 was used for the cylindrical member 100 having a Vickers hardness of 200 HV, a work-hardened material of SUS430 was used for the cylindrical member 100 having a Vickers hardness of 250 HV, a solution-treated material of SUS630 was used for the cylindrical member 100 having a Vickers hardness of 300 HV, an age-hardened material of SUS630 was used for the cylindrical member 100 having a Vickers hardness of 350 HV, and an age-hardened material of SUS630 was used as the material of the cylindrical member 100 having a Vickers hardness of 400 HV. The annealed material of SUS430 was prepared in such a manner that an SUS430 bar formed with a predetermined thickness by drawing treatment was annealed and then formed into a cylinder by cutting. The work-hardened material of SUS430 was prepared in such a manner that an SUS430 bar formed with a predetermined thickness by drawing treatment was annealed, drawn again into a predetermined hardness and then formed into a cylinder by cutting. The solution-treated material of SUS630 was prepared in such a manner that an SUS630 material was subjected to solution treatment and then formed by cutting. Further, the age-hardened material of SUS630 was prepared in such a manner that an SUS630 material was subjected to solution treatment, then formed into a predetermined shape by cutting, and subjected to aging treatment into a predetermined hardness based on JIS G4303:1991. A length of an overlapping portion between each ceramic heater 2 and each cylindrical member 100 was 4 mm. Then, a rear end portion 102 of the cylindrical member 100 and the center pole 5 were welded to each other, and the outer pipe 3 and the metal shell 4 were bonded thereto. Thus, a glow plug 1 was produced.

Contact resistance between the ceramic heater 2 and the cylindrical member 100 in each glow plug 1 was measured by a well-known method. Then, a cycle of heating the ceramic heater 2 for one minute by electricity applied to the glow plug 1 so that the temperature of the overlapping portion between the ceramic heater 2 and the cylindrical member 100 was 200° C., and then cooling the ceramic heater 2 naturally for 30 seconds was repeated 50000 times. Incidentally, the temperature of the overlapping portion was measured by a thermoelectric couple provided on the outer circumferential surface of the cylindrical member 100. Since 200° C. is a temperature higher than the temperature of the overlapping portion in the glow plug 1 used in a general internal combustion engine, 200° C. was set as a target temperature. Then, contact resistance between the ceramic heater 2 and the cylindrical member 100 was measured again. The contact resistance before electrical conduction and the contact resistance after electrical conduction were compared with each other. The glow plug 1 in which increase in contact resistance was not higher than 50 mΩ was judged to be "○", and the glow plug 1 in which increase in contact resistance was higher than 50 mΩ was judged to be "x". Results thereof were as shown in Table 1.

TABLE 1

| | Hardness (HV) | | | | | | |
|---|---|---|---|---|---|---|---|
| | 100 | 150 | 200 | 250 | 300 | 350 | 400 |
| Contact Resistance | X | X | ○ | ○ | ○ | ○ | ○ |

According to Table 1, increase in contact resistance in each glow plug 1 having a cylindrical member 100 exhibiting a Vickers hardness of not lower than 200 HV was not higher than 50 mΩ whereas increase in contact resistance in each glow plug 1 having a cylindrical member 100 exhibiting a Vickers hardness of not higher than 150 HV was higher than 50 mΩ. Thus, when the Vickers hardness of the cylindrical member 100 is set to be not lower than 200 HV, increase in contact resistance can be suppressed so that good electrical conductivity can be obtained.

Example 2

Next, the relation between durability and means of fixing the metal shell 4 and the center pole 5 to each other in each glow plug 1 using a cylindrical member 100 having a Vickers hardness of not lower than 200 HV was examined. First, ten glow plugs 1 provided with cylindrical members 100 with a Vickers hardness of 100 HV, 200 HV or 300HV as used in Example 1 were prepared. Incidentally, in this example, an O-ring 6 made by rubber (fluoro rubber) and an insulating bush 7 as described in the embodiment were used as the means of fixing the metal shell 4 and the center pole 5 to each other. On the other hand, in a comparative example, a glass seal 96 as described in Patent Document 1 was used. Each glow plug 1 was mounted in a direct-injection common-rail (intercooler-including turbocharger) Diesel engine with a displacement of 3000 cc, and electricity was applied to the glow plug 1 to drive the engine. Then, electricity applied to the glow plug 1 was cut off and the engine was driven continuously for 250 hours while the overlapping portion between the ceramic heater 2 and the cylindrical member 100 was kept at a temperature not higher than 100° C. The glow plug 1 was then removed from the engine to observe whether cracks occurred in the ceramic heater 2 of the glow plug 1 or not. The number of glow plugs 1 with occurrence of cracks was counted. Results thereof were as shown in Table 2.

TABLE 2

| | Hardness (HV) | | |
|---|---|---|---|
| | 100 | 200 | 300 |
| Comparative Example | 2 pieces | 8 pieces | 9 pieces |
| Example | 0 piece | 0 piece | 0 piece |

According to Table 2, among the glow plugs 1 in which the cylindrical members 100 with a Vickers hardness of 100 Hv were used, cracks occurred in two glow plugs 1 in the comparative example whereas cracks occurred in zero glow plug 1 in the example. On the other hand, among the glow plugs 1 in which the cylindrical members 100 with a Vickers hardness of 200 Hv were used, cracks occurred in eight glow plugs 1 in the comparative example whereas cracks occurred in zero glow plug 1 in the example. Further, among the glow plugs 1 in which the cylindrical members 100 with a Vickers hardness of 300 Hv were used, cracks occurred in nine glow plugs 1 in the comparative example while cracks occurred in zero glow plug 1 in the example. Accordingly, it is proved that cracks cannot be suppressed sufficiently by the glass seals 96 in the glow plugs 1 including the cylindrical members 100 with a Vickers hardness of 200 HV or higher whereas cracks can be prevented effectively by use of the O-rings 6 and the insulating bushes 7 as in the glow plugs 1 according to the invention.

Figure 5:
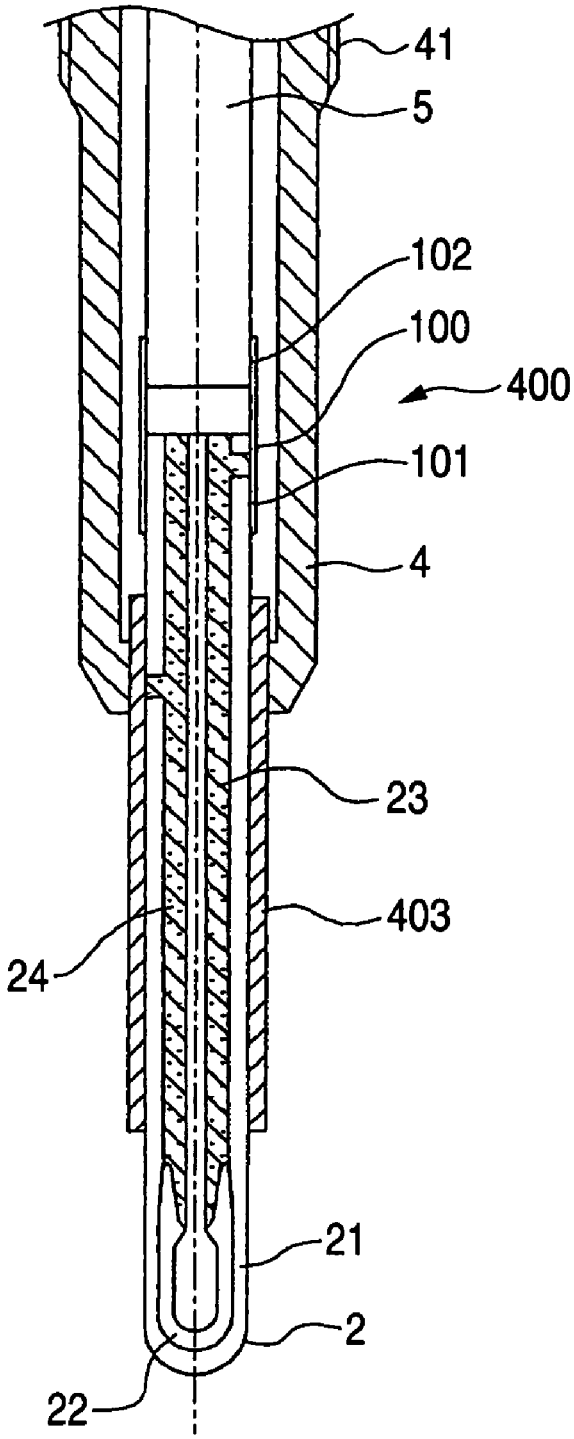
[FIG. 5] A longitudinal section showing a first modification of the glow plug 1 in FIG. 1.
Figure 6:
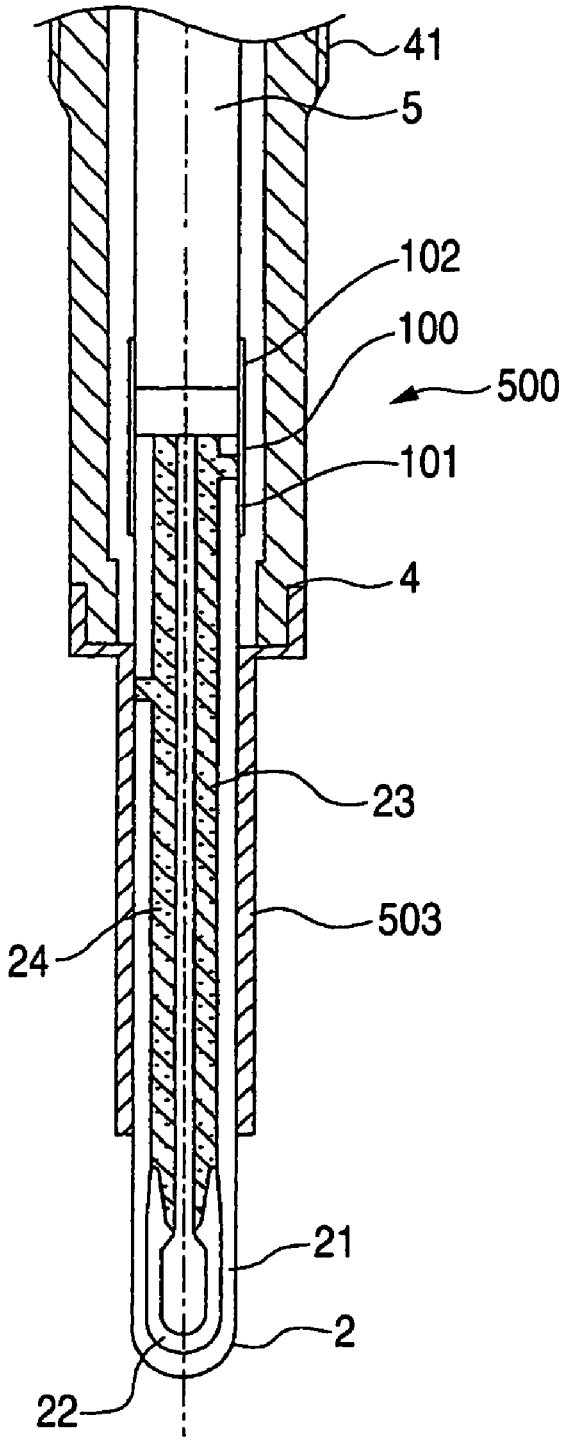
[FIG. 6] A longitudinal section showing a second modification of the glow plug 1 in FIG. 1.
Figure 7:
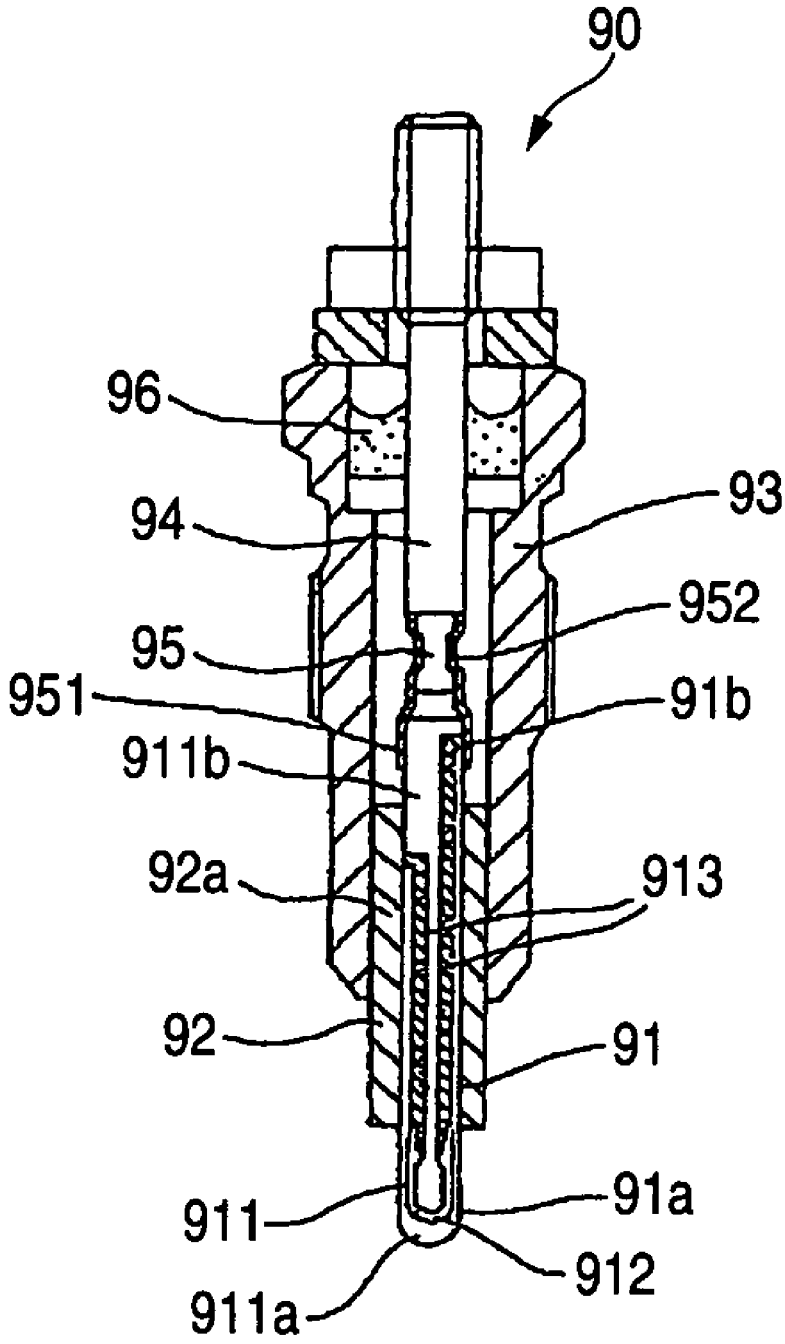
[FIG. 7] An explanatory view of a glow plug 90according to the background art.

Incidentally, the present invention is not limited to the aforementioned specific embodiment. Various changes may be made on the embodiment in accordance with the object and purpose of use within the scope of the present invention. For example, although the cylindrical member 100 shaped like a cylinder as a whole is used in the glow plug 1 according to Embodiment 1, a metal member in which only the front end portion to be bonded to the ceramic heater 2 is shaped like a cylinder while the other portion is shaped like a plate may be used instead, or a metal member in which each of the front and rear end portions is shaped like a cylinder while an intermediate portion for connecting the front and rear end portions to each other is shaped like a plate may be used instead. Moreover, although the protrusion portion 31 is provided in the outer pipe 3, the present invention is not limited thereto. A cylindrical outer pipe 403 may be provided instead as shown in FIG. 5. With this configuration, the number of steps and cost in manufacturing the outer pipe can be reduced. Alternatively, an outer pipe 503 having an increasing diameter in a rear end side of the pipe may be provided as shown in FIG. 6. With this configuration, the front end of the metal shell can be fixed to a boundary portion between a large diameter portion and a small diameter portion of the outer pipe, so that an outer pipe easy to position can be produced.

Although Embodiment 1 has been described on the case where the heating portion 22 is embedded in the ceramic heater body 21 in the glow plug 1, the present invention is not limited thereto. The heating portion 22 may be exposed to an outer circumferential surface of the front end portion of the ceramic heater body 21.

While the present invention has been described in detail and with reference to the specific embodiment, it is obvious to those skilled in the art that various changes and modifications may be made on the present invention without departing from the sprit and scope of the present invention.

The present application is based on a Japanese Patent application (Patent Application No. 2004-043378) filed on Feb. 19, 2004, and contents thereof will be incorporated herein by reference.

The invention claimed is:

1. A glow plug comprising:

a rod-shaped ceramic heater including a ceramic heater body extending axially, a heating portion embedded in a front end portion of said ceramic heater body and being capable of generating heat upon energization, and a pair of lead portions each having one end connected to said heating portion, and the other end exposed to an outer circumferential surface of a rear end portion of said ceramic heater body;

a rod-shaped center pole extending axially so as to electrically connect to the outside; and a cylindrical member including a front end portion bonded to an outer circumferential surface of a rear end side of said ceramic heater, and a rear end portion bonded to an outer circumferential surface of a front end side of said center pole, said cylindrical member being made by a metal material for electrically connecting one of said pair of lead portions and said center pole to each other, wherein said cylindrical member has a Vickers hardness of not lower than 200 HV at 25° C.

2. The glow plug as claimed in claim 1, wherein said front end portion of said cylindrical member is bonded to said outer circumferential surface of said rear end side of said ceramic heater by tight fitting.

3. The glow plug as claimed in claim 2, wherein said tight fitting is press fitting.

4. The glow plug as claimed in claim 1, wherein said glow plug further comprises:

an outer pipe for holding said ceramic heater while front and rear end portions of said ceramic heater are protruded from said outer pipe;

a metal shell for surrounding a frond end side of said center pole while holding said outer pipe; and an elastic member disposed so as to be located in a gap between said center pole and said metal shell.

5. The glow plug as claimed in claim 4, wherein:

said elastic member is engaged with a rearward surface of said metal shell; and said glow plug further comprises a cylindrical insulating member disposed on a rear end side of said elastic member so as to press said elastic member.

6. The glow plug as claimed in claim 1, wherein said rear end portion of said cylindrical member is bonded to an outer circumferential surface of a front end side of said center pole by welding.

7. The glow plug as claimed in claim 1, wherein said cylindrical member has a Vickers hardness of not greater than 500 HV at 25° C.

8. The glow plug as claimed in claim 1, wherein said cylindrical member is made of stainless steel.

9. A glow plug comprising:

a rod-shaped ceramic heater including a ceramic heater body extending axially, a heating portion embedded in a front end portion of said ceramic heater body and being capable of generating heat upon energization, and a pair of lead portions each having one end connected to said heating portion, and the other end exposed to an outer circumferential surface of a rear end portion of said ceramic heater body;

a rod-shaped center pole extending axially so as to electrically connect to the outside; and a metal member having a cylindrical front end portion bonded to an outer circumferential surface of a rear end side of said ceramic heater, and a rear end portion bonded to an outer circumferential surface of a front end side of said center pole, said metal member being provided for electrically connecting one of said pair of lead portions and said center pole to each other, wherein said metal member has a Vickers hardness of not lower than 200 HV at 25° C.

10. The glow plug as claimed in claim 9, wherein said metal member has a Vickers hardness of not greater than 500 HV at 25° C.

11. The glow plug as claimed in claim 9, wherein said metal member is made of stainless steel.

* * * * *